United States Patent [19]

Tunis

[11] 4,014,436

[45] Mar. 29, 1977

[54] DISPLAY CONTAINER FOR FOLDED BELT-LIKE OBJECTS

[75] Inventor: Philip Tunis, Port Chester, N.Y.

[73] Assignee: Ben Tunis Company, Inc., Rye, N.Y.

[22] Filed: Sept. 18, 1975

[21] Appl. No.: 614,824

[52] U.S. Cl. ..... 206/492; 206/299; 206/806; 229/27

[51] Int. Cl.[2] ..... B65D 85/54

[58] Field of Search ..... 206/44 R, 45.14, 278, 206/280, 288, 292, 296–297, 299, 491–492, 494, 525, 527, 806; 229/16 D, 27

[56] References Cited

UNITED STATES PATENTS

| | | | |
|---|---|---|---|
| 1,699,942 | 1/1929 | Appelbaum | 206/288 |
| 2,319,560 | 5/1943 | Salfisberg | 206/492 |
| 2,755,924 | 7/1956 | Tuttle et al. | 206/296 |
| 2,917,163 | 12/1959 | Baker et al. | 206/299 X |
| 2,941,703 | 6/1960 | Abramowitz | 206/299 X |
| 3,329,386 | 7/1967 | Rosen | 206/299 X |
| 3,794,793 | 2/1974 | Rius | 206/45.14 X |

*Primary Examiner*—Steven E. Lipman

*Attorney, Agent, or Firm*—Blum, Moscovitz, Friedman & Kaplan

[57] ABSTRACT

A display container for a folded, belt-like object is prepared by folding from a scored, flat blank. The top and bottom of the container are open and the sides of the container have folded flaps which form front and rear compartments for preventing the folded belt-like object from sliding through said container.

7 Claims, 4 Drawing Figures

DISPLAY CONTAINER FOR FOLDED BELT-LIKE OBJECTS

BACKGROUND OF THE INVENTION

For point-of-purchase display containers, it is desirable that the objects held in said containers be accessible for examination, that it be difficult to remove the object from the container without destroying same, that the container be inexpensive, and, if possible, preparable by folding from a flat blank of an inexpensive material such as paper or cardboard, that the preparation of the container from the flat blank be susceptible to automation, and that the container be suitable for display on a peg-board. Also, it should be possible to print information such as operating conditions, etc., on the outside of same.

SUMMARY OF THE INVENTION

A flat blank which can be folded into a container is preferably made of paper or cardboard, but may be made of a suitable plastic. In general, the material used should accept printing. To facilitate folding, the material is scored. The container is intended for support and display of an elongated object such as a belt, whether closed or open, the object being folded transversely at at least one region. The object is to be supported in the container with the transverse fold at the top of the object and the container has means therein for preventing the folded object from slipping therethrough.

A blank for folding into a container has a first vertical section with horizontal sections extending out to both sides thereof. The horizontal sections are vertically scored to facilitate folding. When properly folded, the vertical section forms the back of the container, one horizontal section can be folded into one side each of front and rear compartments and a first flap separating said front and rear compartments and a portion of the front wall of the front compartment. The other horizontally-extending section can be folded into the other side walls of the front and rear compartments as well as a second flap separating said front and rear compartments. Said second horizontal section also cooperates in forming the front wall of said front compartment, overlying that portion of said front walls formed by said first horizontal extension, said second horizontal section wrapping around the remainder of said container to the back thereof. Said second horizontal section has a tongue at the end thereof and said first vertical section is vertically grooved to accept said tongue, thereby locking said container together. Said flaps are double-walled, each pair of walls being fastened together as by a staple or cement.

In a preferred embodiment, there are second and third vertical sections at the top and bottom respectively of said first vertical section. These are also scored horizontally so that they can be folded inwardly to form a chamber within said rear compartment for holding accessories to said folded object. Where said folded object is a steering-wheel cover which requires lacing, the laces may be stored in said auxiliary chamber. Further, the vertical section is perforated proximate the top thereof for receiving a peg, whereby said container and the object contained therein may be suspended from a pegboard.

Accordingly, an object of the present invention is a display container for a belt-like object where the object can be examined by the prospective purchaser without disturbing the container.

Another object of the present invention is a display container which can be prepared from a flat blank where the container includes means for preventing a folded, belt-like object from slipping therethrough, the container lacking both top and bottom walls.

A further object of the present invention is a display container which can be prepared from a flat blank by automatic machinery.

An important object of the present invention is a display container which can be prepared from a flat blank, which is suitable for holding a folded, belt-like object and which contains an auxiliary compartment for holding any necessary accessories to said object.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in conjunction with the accompanying drawings, in which.

DESCRIPTION OF THE PREFERRED EMBODIMENTS

Figure 1:
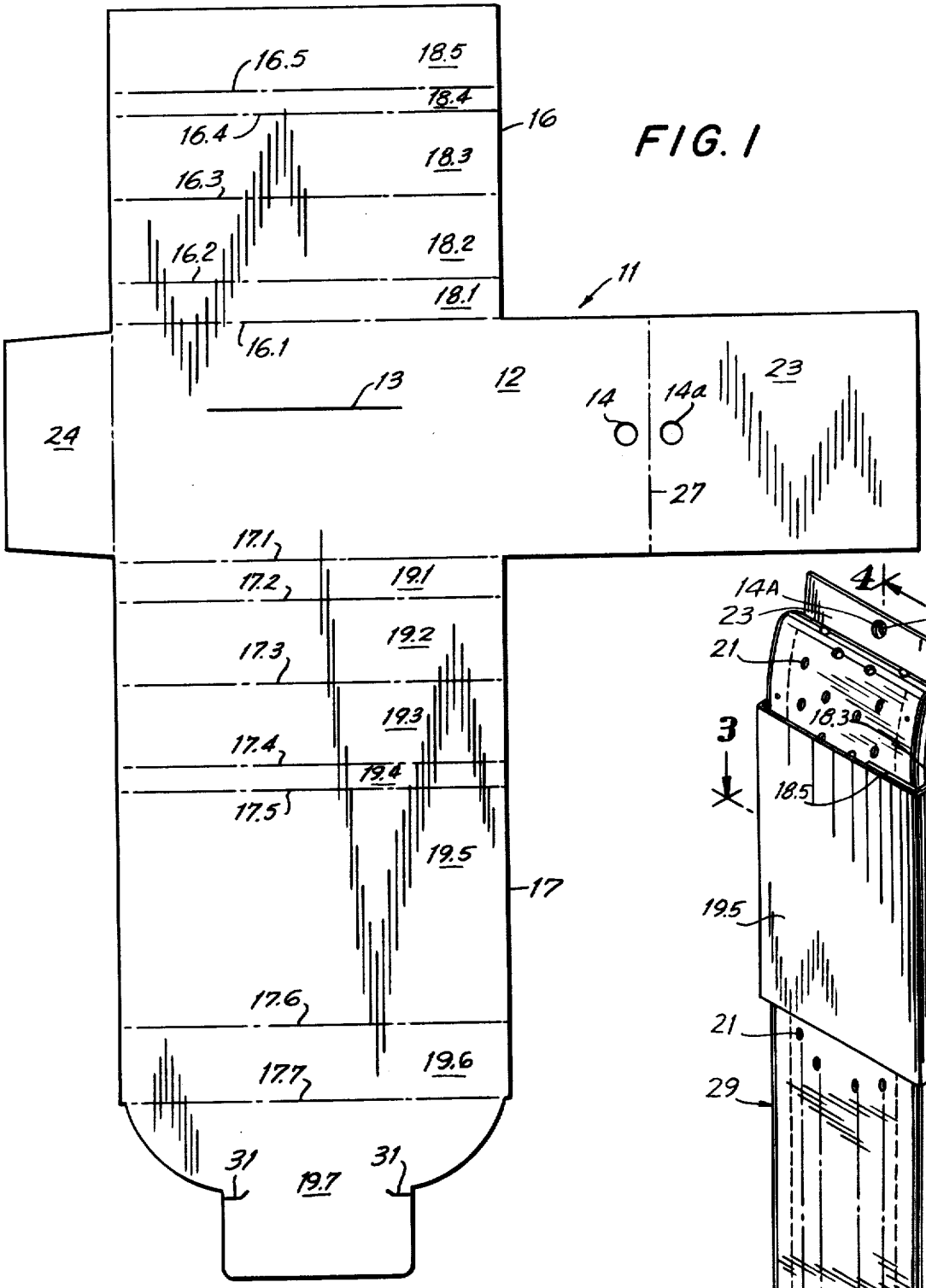
FIG. 1 is a plan view of a flat blank which can be folded up into a container in accordance with the present invention.

The container of the present invention is shown in the form of a flat blank, indicated generally by the reference numeral 11 in FIG. 1. Section 12 of said blank is designated as the first vertical section since it is vertical with respect to its longest dimension when in use. Section 12 has a vertical slot 13 therein. Also, it has therein an aperture 14 for receiving a peg, so that the container, when in use, may be suspended from a peg. Extending out from the vertical sides of section 12 are horizontal sections 16 and 17, each of them being scored for facilitating folding. Section 16 has five scores, labelled 16.1 through 16.5. Section 17 has seven scores labelled 17.1 through 17.7. Preferably, scores 16.1 and 17.1 are at opposite vertical edges of vertical section 12. Horizontal section 16 is divided by the vertical scores thereacross into five strips 18.1 through 18.5 and section 17 is divided by the vertical scores thereon into strips 19.1 through 19.6 and tongue section 19.7.

Figure 3:
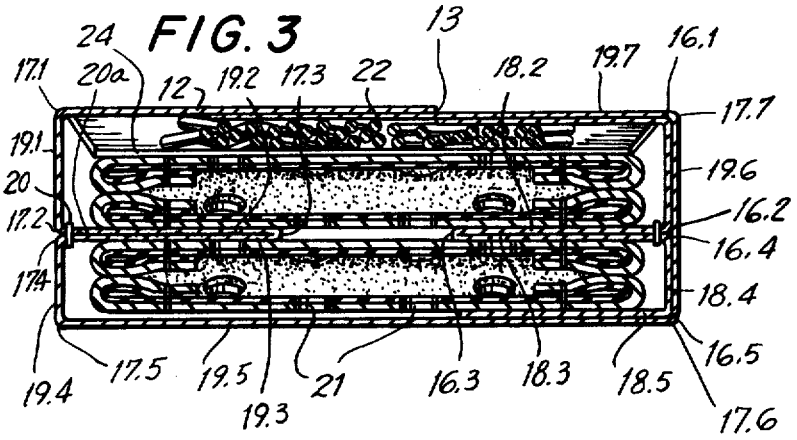
FIG. 3 is a sectional view taken along line 3—3 of FIG. 2.

FIG. 3 shows how folding is carried out at scores 16.1 and 16.2 to form one side wall of the rear compartment. Section 16 is bent in the reverse direction at score 16.3 in order to form the flap consisting of the two strips 18.2 and 18.3. Also, as will be noted, section 16 is folded at score 16.5 to form a portion of the front wall of the container by means of strip 18.5.

In similar fashion, strip 17 is bent to form the other side walls of the front and rear compartments by means of stips 19.1 and 19.4. As before, a double-walled flap is formed by strips 19.2 and 19.3. Strip 19.5 overlies strip 16.5 and completes the front wall of the front chamber. Strip 17 is carried around the other side walls of the two chambers and around part of section 12 so that tongue 19.7 can be inserted in flap 13 to hold the assembly together.

As is evident, either of the double-walled flaps could be used to form the two compartments in the container. However, it is preferred to have a flap at each side of the container. Moreover, the two walls of each flap must be held together. The preferred means is a staple 20 which can be punched through each of the double walls during the folding operation. Alternatively, an adhesive or cement 20*a* can be used to hold the two walls of each flap together.

Figure 2:
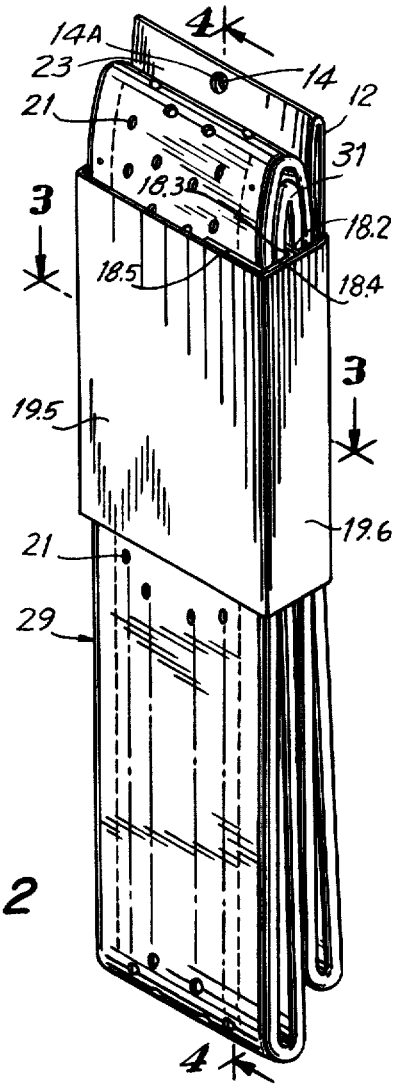
FIG. 2 is a view in perspective of said container holding a belt-like object in folded condition.
Figure 4:
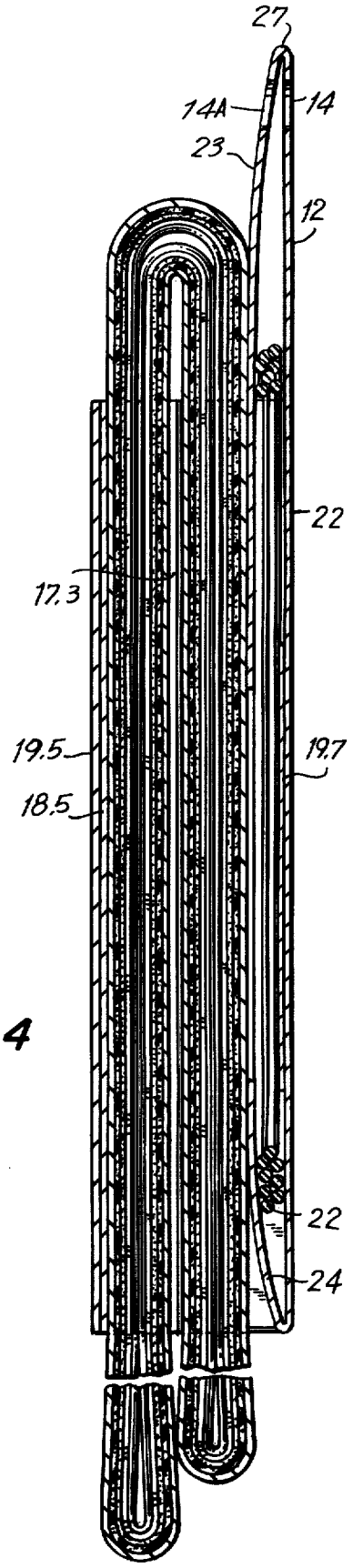
FIG. 4 is a sectional veiw taken along line 4—4 of FIG. 2.

In some cases, auxiliary equipment or material may be needed with the belt-like object. A specific instance is that of a steering-wheel cover which requires laces. Such a steering-wheel cover in a container in accordance with the present invention is shown in FIG. 2. As can be seen, perforations in the steering-wheel cover are shown in FIG. 2 with the reference numeral 21. The laces themselves are shown in FIG. 3 in section with the reference numeral 22. To hold the laces in place in the container, the flat blank has second and third vertical sections 23 and 24 at the top and bottom, respectively, of section 12. A score 26 is provided between sections 12 and 24, and a score 27 is provided between sections 12 and 23. Conveniently, score 26 is at or proximate the bottom of section 12 and therefore, essentially, in line with the bottoms of sections 16 and 17. Preferably, score 27 is above the tops of sections 16 and 17. When sections 23 and 24 are folded inwardly, the form an auxiliary chamber in which laces or other auxiliary materials can be stored as shown in FIGS. 3 and 4.

Section 23 has an aperture 14*a* therein which is in registry with aperture 14 in section 12 when section 23 is folded over. Thus, when mounted on a peg-board, a single pin or peg can pass through both apertures 14 and 14*a*.

Where the container is made of cardboard, the inner surface is preferably unfinished and the exterior surface preferably has a glossy coating thereon which will accept printing. The combination minimizes the cost while making available an attractive container.

The belt-like object to be held in such a container is given the reference number 29 in FIG. 2. While the object 29 of FIG. 2 has three folds therein, the fold at the top having the reference numeral 31 is regarded as the principal fold. It is with this fold that the flaps interfere against the action of gravity which would tend to pull the object down through the container. The flap visible in FIG. 2 consists of the two vertical strips 18.2 and 18.3.

Tongue 19.7, conveniently has slits 31 at the base thereof for locking said tongue in slot 13 on completion of the closure of the container.

With the foregoing construction, a container is simply and inexpensively formed for the packaging of a belt-like object having a principal fold intermediate the ends thereof. The container packages the object for point-of-purchase display in such a manner that the object can be examined by the prospective purchaser without removing the object from the container and without removing the container from the display. The container encloses the object sufficiently to prevent inadvertent removal.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. Point-of-purchase display container for a folded belt-like object having front and back walls and a pair of sidewalls, said object having a principal fold dividing same into first and second segments and said container being so shaped that it can be fashioned from a single flat blank, said container back wall comprising a first vertical section having two vertical sides, a top edge and one of said container side walls comprising and a bottom edge, a first horizontal section extending outwardly essentially at right angles from one of said vertical sides, said first horizontal section having five vertical scores thereon to facilitate folding, the first of said scores being the junction of said first horizontal section and one of said vertical sides of said first vertical section, said five score marks dividing said first horizontal section into five vertical strips, and, numbering said strips outwardly from said first vertical section, on folding said first horizontal section, said first vertical strip forms a first side wall of a first compartment, said second and third vertical strips form a first flap inside said container, said fourth vertical strip forms a first side wall of a second compartment and said fifth vertical strip said container front wall.

2. The point-of-purchase display container for a folded belt-like object, as claimed in claim 1, wherein said flap is held together by fastening means.

3. The point-of-purchase display container for a folded belt-like object, as claimed in claim 2, wherein said fastening means are staples.

4. The point-of-purchase display container for a folded belt-like object, as claimed in claim 2, wherein said fastening means is an adhesive.

5. The point-of-purchase display container for a folded belt-like object, as claimed in claim 1, wherein said container further comprises a second vertical section extending downwardly from said bottom edge of said first vertical section, said second vertical section being horizontally scored to facilitate folding inwardly, inner face to inner face, to form an auxiliary chamber within said container.

6. The point-of-purchase display container for a folded belt-like object, as claimed in claim 1, wherein said container further comprises a third vertical section extending upwardly from said first vertical section with the score line therebetween and said first and third vertical sections are apertured on opposite sides of said score line, whereby said apertures, come into registry for receiving a single peg when said third vertical sections fold inwardly.

7. The point-of-purchase display container for a folded belt-like object as claimed in claim 1, the other container side wall comprising a second horizontal section extending outwardly essentially at right angles from the other of said vertical sides, said second horizontal section having seven vertical scores thereon to facilitate folding, the first of said scores being at the junction of said second horizontal section and the other of said vertical sides of said first vertical section, said seven scores dividing said second horizontal section into six vertical strips and a tongue, and numbering said vertical strips in said second horizontal section outwardly from said first vertical section starting with six, on folding said second horizontal section, said sixth vertical strip forms a second side wall of said first compartment, said seventh and eighth vertical strips form a second flap inside said container, said ninth vertical strip forms a second side wall of said second compartment of said container, said tenth vertical strip forms a remainder of said container front wall and overlies said fifth vertical strip, said eleventh vertical strip overlies said first and fourth vertical strip and said tongue overlies a said portion of said first vertical section, said vertical section being grooved for receiving said tongue to hold said container together.

* * * * *